United States Patent [19]

Barbrook

[11] 3,993,972

[45] Nov. 23, 1976

[54] ELECTRO-MAGNETIC DEVICES

[75] Inventor: Arthur Laurence Barbrook, Sutton Coldfield, England

[73] Assignee: Lucas Industries, Limited, Birmingham, England

[22] Filed: July 2, 1975

[21] Appl. No.: 592,371

[30] Foreign Application Priority Data

Aug. 14, 1974 United Kingdom ..... 35696/74

[52] U.S. Cl. ..... 335/220; 335/281

[51] Int. Cl.[2] ..... H01F 7/08

[58] Field of Search ..... 335/220, 236, 297, 281, 335/227, 85, 91

[56] References Cited

UNITED STATES PATENTS 2,285,560 6/1942 Bonanno ..... 335/236

2,318,359 5/1943 Bellows, Jr. ..... 335/236

FOREIGN PATENTS OR APPLICATIONS 599,235 1/1926 France ..... 335/220

*Primary Examiner*—Harold Broome

[57] ABSTRACT

An electro-magnet includes a pole-piece having a portion of reduced cross-section. The shape of the reduced portion provides a restriction in the magnetic circuit such that the distance moved, against a biasing force, by an armature of the electro-magnet is proportional to the current in the electro-magnet winding. The pole piece comprises aligned parts of nickel-iron alloy joined by a soft iron part whose cross-section is less than that of the nickel-iron alloy parts.

6 Claims, 1 Drawing Figure

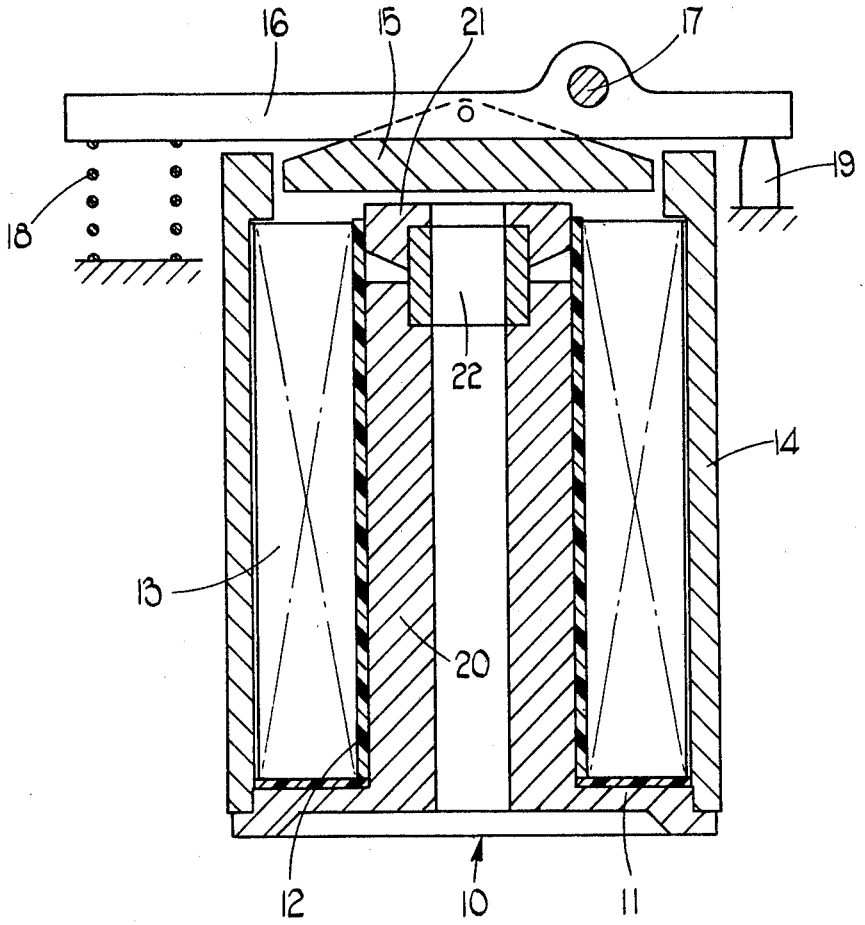
16
15
21
17
19
18
22
14
13
20
12
10
11

ELECTRO-MAGNETIC DEVICES

This invention relates to electro-magnetic devices.

It is known, from British Patent Specification No. 1,024,112, to provide an electro-magnetic device having a central pole piece surrounded by a winding, the pole piece being formed intermediate its ends with a waisted portion to provide a restriction in the magnetic circuit such that the distance through which an associated armature is moved, against a biasing force, is substantially proportional to the current flowing in the winding. It is the normal practice to make the central pole piece from a nickel iron alloy, such as that commercially available under the name "Permalloy B. " The flux density at which nickel iron alloy saturates decreases with increasing temperature, there being, typically, a 9% reduction in the saturated flux density between 20° C and 180° C. Thus, to maintain a given flux density in an air gap between the pole piece and the armature, a substantial increase in the current in the winding is required at elevated temperatures. It is an object of the present invention to provide an electro-magnetic device in which the foregoing disadvantage is substantially reduced.

According to the invention an electro-magnetic device includes a central pole piece, a winding surrounding said pole piece, an armature attractable into contact with the pole piece and a spring urging the armature away from the pole piece, the pole piece having first and second axially aligned parts of nickel iron alloy and a soft iron part joining said first and second parts and having a cross sectional area less than that of either said first or said second part, said soft iron part defining, intermediate the ends of said pole piece, a waisted portion which provides a restriction in the magnetic circuit of the device, the shape of said waisted portion being such that the distance through which the armature moves against the action of the spring is substantially proportional to the current flowing in the winding.

In a preferred embodiment said first and second parts and said soft iron part are substantially cylindrical.

In a further preferred embodiment said soft iron part is engaged in recesses in adjacent end faces of said first and second parts respectively.

An example of the invention will now be described with reference to the accompanying drawing.

The magnetic device shown has a central pole piece 10 having an integral flange 11. The pole piece 10 supports an insulating former 12 about which there is a winding 13. An annular member 14 of magnetic material engages the flange 11 and surrounds the winding 13. An armature 15 is mounted for pivotal movement with respect to a lever 16. Lever 16 can move about a spindle 17 and is biased by a spring 18 against an abutment 19 so as to urge armature 15 away from the pole piece.

Pole piece 10 is formed in three parts. First and second parts 20, 21 are in the form of cylindrical tubes and are axially aligned in spaced relationship. Parts 20, 21 are formed of a nickel-iron alloy of the type commercially available under the name "Permalloy B," this alloy having the characteristics of high permeability and low hysteresis. Between the parts 20, 21 is a soft iron bush 22 which engages recesses in the adjacent faces of the parts 20, 21 so as to maintain the latter in their axially aligned, spaced relationship. The end face of part 21 which is adjacent the part 22 is relieved, as shown, to provide a projecting frusto-conical surface co-axial with the axis of the pole piece 10 and having an included angle of between 130° and 160°.

The bush 22 and adjacent faces of the parts 20, 21 define a waisted portion of the pole piece 10. The shape of the waisted portion is such that after magnetic saturation has taken place in the neck defined by the soft iron bush 22, any further increases in magnetising force causes the circuit flux to leak across a progressively wider space between the parts 20, 21. Thus, after initial saturation of the bush 22, increasing magnetising force produces an effective increase in the pole piece cross section. The effective reluctance of the magnetic circuit, however, increases with the effective cross section, due to the wider gap between parts 20, 21 which the flux must cross.

The dimensions of the bush 22 and parts 20, 21 are so chosen that the effect is to correct the tendency, in a device of this kind, for the force exerted against the spring 18 to rise steeply as the air gap between the pole piece 10 and armature 15 decreases, and in the device of the present invention an almost linear force/distance curve results. In the present example outside diameters of the portions 20, 21 are 17.55 mm and the outside diameter of bush 22 is 9.14 mm.

It has been found that with this type of pole piece an electro-magnetic device of the kind described has a reduced sensitivity to increases in temperature. The axial length of bush 22 is maintained at the minimum necessary to effect the connection between parts 20, 21. The advantages of low hysteresis and high permeability obtained with "Permalloy B" are retained.

I claim:

1. An electro-magnetic device, including a central pole piece, a winding surrounding said pole piece, an armature attractable into contact with the pole piece and a spring urging the armature away from the pole piece, the pole piece having first and second axially aligned parts of nickel iron alloy and a soft iron part joining said first and second parts and having a cross sectional area less than that of either said first or said second parts, said soft iron part defining, in combination with adjacent ends of said first and second parts, a waisted portion intermediate the ends of said pole piece, said waisted portion providing a restriction in the magnetic circuit of the device, the shape of said waisted portion being such that the distance through which the armature moves against the action of the spring is substantially proportional to the current flowing in the winding.

2. A device as claimed in claim 1 in which said first and second parts and said soft iron part are substantially cylindrical.

3. A device as claimed in claim 1 in which said first and second parts and said soft iron part are tubular.

4. A device as claimed in claim 1 in which said soft iron part is engaged in recesses in adjacent end faces of said first and second parts respectively.

5. A device as claimed in claim 4 in which one of said end faces is a frusto-conical surface which projects towards the other of said end faces.

6. A device as claimed in claim 5 in which said frusto-conical surface has an included angle of between 130° and 160°.

* * * * *